US006892773B1

(12) United States Patent
Wenzler

(10) Patent No.: US 6,892,773 B1
(45) Date of Patent: May 17, 2005

(54) CARRIER FOR GOLF BAG

(76) Inventor: Thomas Wenzler, 12 Homecoming Pl., Setauket, NY (US) 11733

( * ) Notice: Subject to any disclaimer, the term of this patent is extended or adjusted under 35 U.S.C. 154(b) by 0 days.

(21) Appl. No.: 10/429,757

(22) Filed: May 5, 2003

Related U.S. Application Data

(63) Continuation of application No. 09/639,437, filed on Aug. 12, 2000, now abandoned.

(51) Int. Cl.[7] ..... A63B 57/00
(52) U.S. Cl. ..... 150/159; 206/315.4
(58) Field of Search ..... 150/156, 160, 150/154, 159; 206/315.3, 315.4

(56) References Cited

U.S. PATENT DOCUMENTS 1,254,669 A * 1/1918 Fovargue ..... 206/315.4
1,325,692 A * 12/1919 Cross ..... 206/315.4
1,442,906 A * 1/1923 Rawlings et al. ..... 206/315.4
3,913,648 A * 10/1975 Sessler ..... 206/315.4
3,985,171 A * 10/1976 Summers et al. ..... 150/159
4,657,135 A * 4/1987 Kjose ..... 206/315.3
5,058,642 A * 10/1991 Tuntland ..... 150/159
5,383,505 A * 1/1995 Cordasco, Jr. ..... 150/159
5,402,883 A * 4/1995 Shin ..... 206/315.3
5,515,897 A * 5/1996 Fehan ..... 150/159
5,676,247 A * 10/1997 Shioda ..... 206/315.4
5,704,475 A * 1/1998 Jack ..... 206/315.4
5,830,119 A * 11/1998 Chen ..... 493/210
6,161,698 A * 12/2000 Bradshaw et al. ..... 206/527
6,202,840 B1 * 3/2001 Chang ..... 206/315.4
6,330,944 B1 * 12/2001 DeMichele ..... 206/315.3

* cited by examiner

*Primary Examiner*—Sue A. Weaver
(74) *Attorney, Agent, or Firm*—Furgang & Adwar, LLP

(57) ABSTRACT

A carrier for a golf bag completely encloses the golf bag and has a bottom section, a middle section and a top section. The bottom section is formed in part by a rigid plastic plate that supports two wheels. The wheels allow easy transportation of the carrier. The middle section of the bag supports pockets for carrying golf accessories such as shoes, balls and tees. The top section is padded and has at least one set of cords. Each cord is separated into two pieces. Each piece has an end secured to the interior of the bag and extends through a grommet to the exterior of the bag. The two cords can be pulled together and releasably connected. When the cords are pulled together and connected, the effective diameter and interior volume of the bag are reduced. This reduces the room for the clubs to move and cause damage to each other by impact.

24 Claims, 5 Drawing Sheets

FIG.4
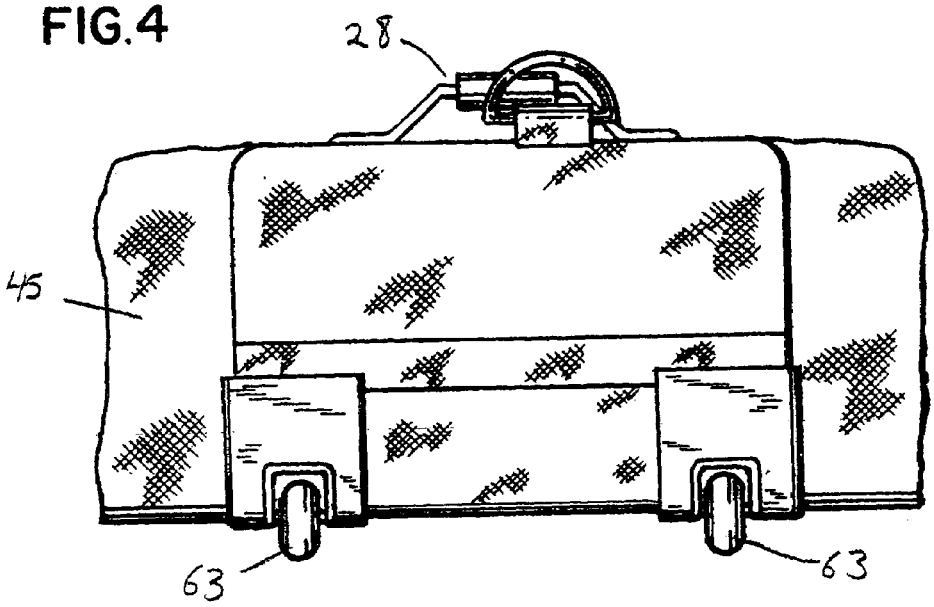
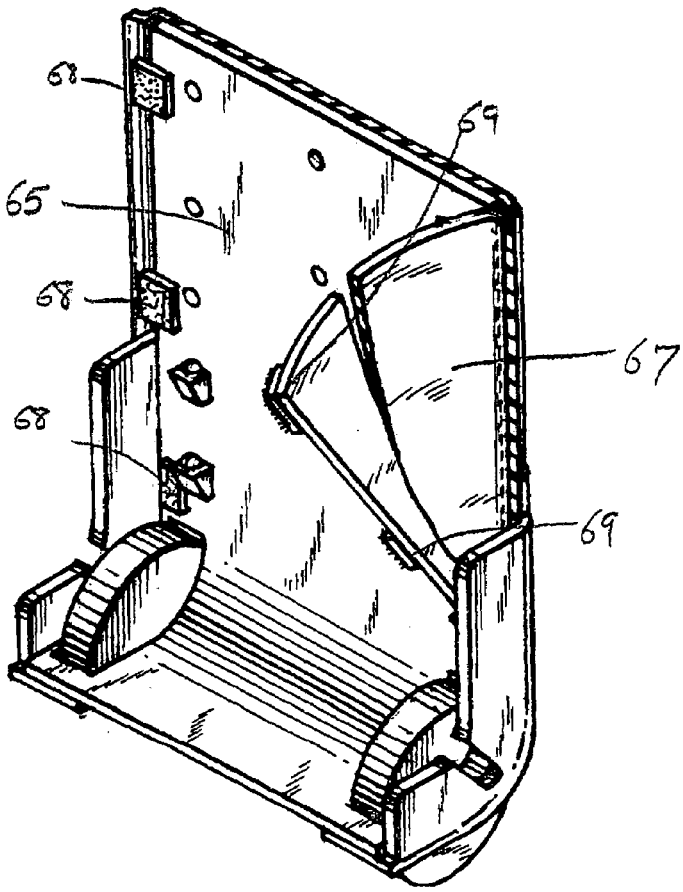
FIG.5

CARRIER FOR GOLF BAG

CROSS-REFERENCE TO RELATED APPLICATION

This application is a continuation of application Ser. No. 09/639,437, filed Aug. 12, 2000 now abandoned.

FIELD OF THE INVENTION

A carrier for the transportation and storage of a golf bag.

BACKGROUND OF THE INVENTION

Golf clubs have to be transported every time the golfer plays a round. The golfer most often keeps his golf clubs at home and must bring them to and from a golf course when playing. This necessitates placing the golf bag into the trunk and driving to the golf course. Also, it is common for golfers to take clubs on vacation in order to play at golf courses near their destination. Golf bags are large items and need to be checked at airports. When checked as baggage, the golf bag needs some way to retain the clubs within the bag. More importantly, the golf bag needs to be protected from damage as it is loaded through the baggage handling system on to and off of the plane.

Many prior art devices have been developed for the protection of a golf bag during transportation, whether by car or plane. A common type of protector is a hard sided case, much like a large suitcase. The golf bag is placed within the case, and the case locked shut. This provides a hard shell to protect the golf bag from external impacts. These protectors take up space when not being used.

It is also possible that the clubs can be damaged from hitting one another. The golf clubs have freedom to move when placed in a golf bag. As a golf bag is being transported, the golf clubs can impact against one another with enough force to cause damage to the clubs. There is a need in the art for a carrier for a golf bag that protects the golf bag and clubs from both external impacts and from damage caused by the clubs themselves.

It is an object of the invention to provide a carrier for a golf bag that protects the golf bag from external impacts.

It is another object of the invention to provide a carrier that restrains movement of the golf clubs to prevent them from damaging themselves.

It is still another object of the invention to provide a lightweight carrier for a golf bag.

It is yet another object of the invention to provide a carrier for a golf bag that is easily transported.

It is another object of the invention to provide a carrier for a golf bag that is both inexpensive to manufacture and durable.

It is still another object of the invention to provide a carrier for a golf bag that is collapsible when not being used.

It is another object of the invention to provide a carrier that is convenient for the golfer to use for transportation of the golf bag.

These and other objects of the invention will become apparent after reading the disclosure of the invention as follows.

SUMMARY OF THE INVENTION

A carrier for a golf bag completely encloses the golf bag and has a bottom section, a middle section and a top section. The bottom section is formed in part by a rigid plastic plate that supports two wheels. The wheels allow easy transportation of the carrier. The middle section of the bag supports pockets for carrying golf accessories such as shoes, balls and tees. The top section is padded and has at least one set of cords. Each cord is separated into two pieces. Each piece has an end secured to the interior of the bag and extends through a grommet to the exterior of the bag. The two cords can be pulled together and releasably connected. When the cords are pulled together and connected, the effective diameter and interior volume of the bag are reduced. This reduces the room for the clubs to move and cause damage to each other by impact.

The bag is provided with a top handle connected to the top of the bag, a bottom handle connected to the front of the bag proximate the bottom of the bag, a pair of hand straps connected to the middle section of the bag and a shoulder strap that traverses the length of the bag. These various handles and straps provide a variety of ways for the golfer to transport the bag. A zipper runs the full length of the bag to provide easy access to the interior of the bag. The carrier represents a convenient, easy-to-use manner to transport the bag by automobile or plane.

BRIEF DESCRIPTION OF THE DRAWINGS

FIG. 4 is a view along line 4—4 of FIG. 2 showing a bottom view of the bag;

FIG. 5 is a cut-away view along line 5—5 of FIG. 2 showing the wheel and base assembly of the bag;

DETAILED DESCRIPTION OF THE INVENTION

Figure 1:
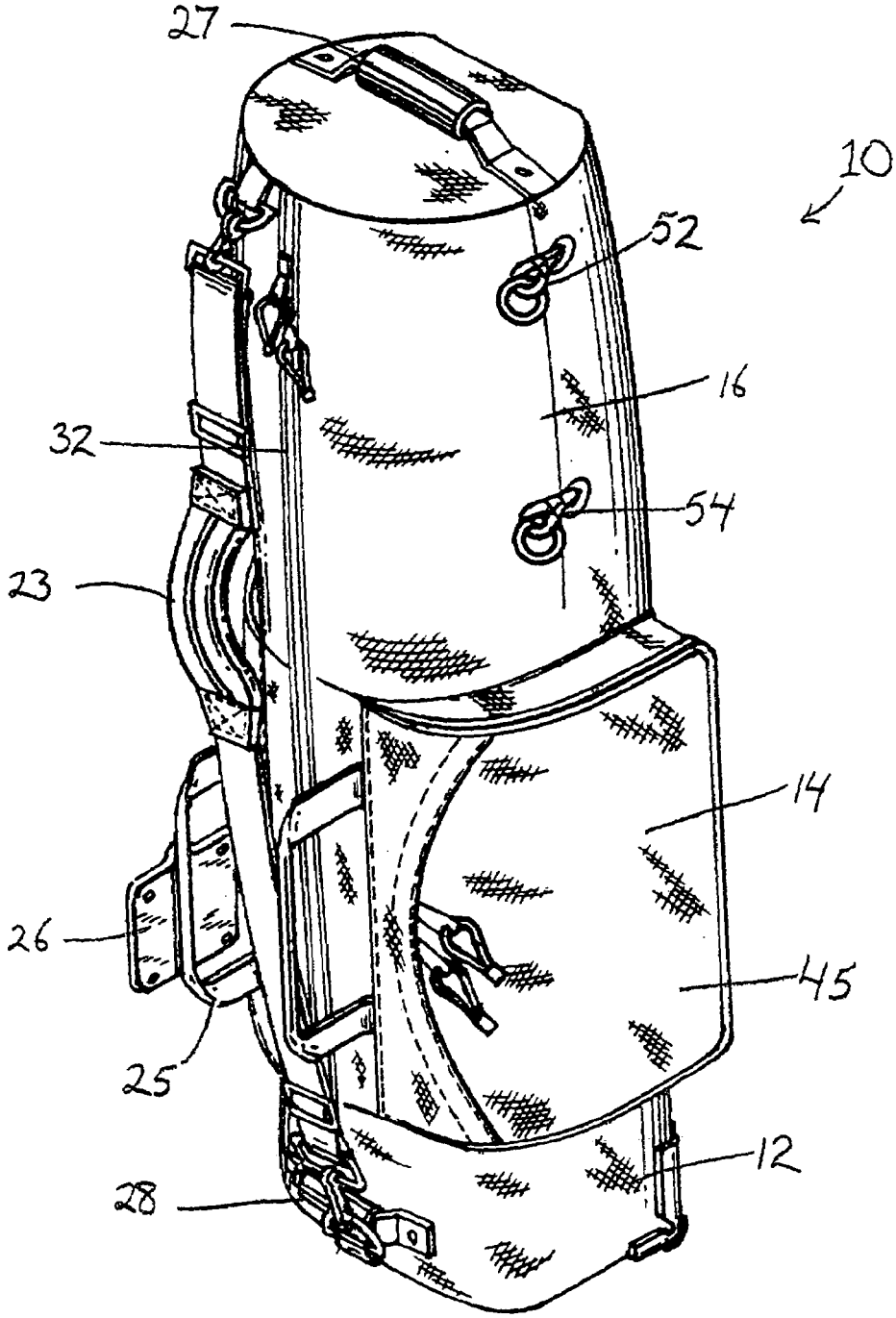
FIG. 1 is a right perspective view of the bag.

The general construction of the bag can be seen with reference to FIG. 1. The bag 10 is soft sided and has a bottom portion 12, a middle portion 14 and an upper portion 16. On the side of the bottom portion, proximate the bottom surface of the bag, a bottom handle 28 is provided. A pair of side pockets 45 extend from either side of the bag. These pockets are closed by zippers. The middle portion 14 also has a pair of hand straps 25. The hand straps are positioned on either side of the zipper 32 that traverses the full length of the bag. A strap connector 26 is permanently connected to one of the straps 25. A shoulder strap 32 is connected to D-rings located at the top and the bottom of the bag. A top handle 27 is connected to the top surface of the bag. A first cord 52 is seen as it extends through the grommet in the side of the bag. Located below this first cord is a second cord 54.

Figure 2:
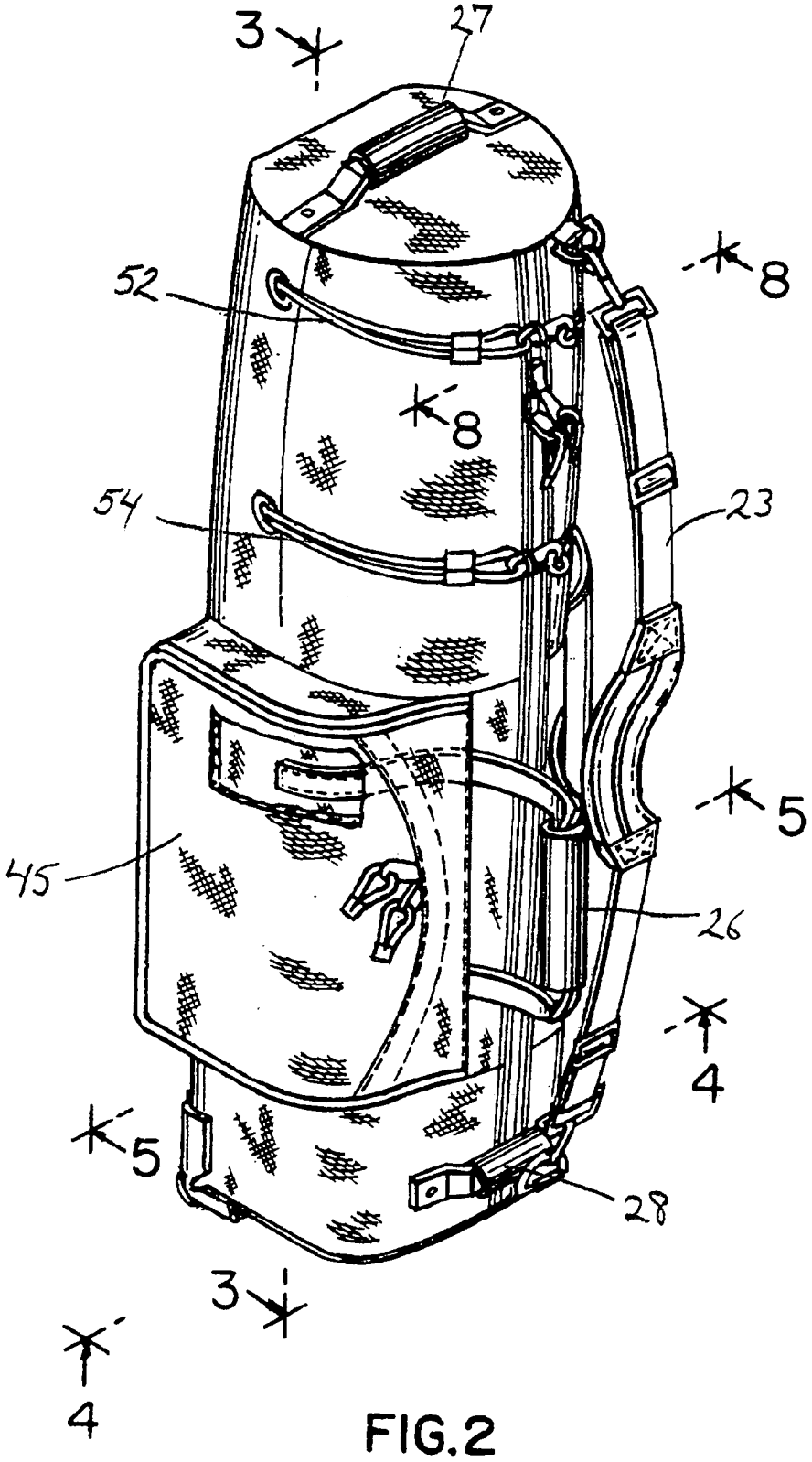
FIG. 2 is a left front perspective view of the bag.

The left front perspective view is shown in FIG. 2. All of the elements are seen in this view, as were seen in FIG. 1, as the bag is symmetrical. However, in this view, the hand straps 25 are connected together by the strap connection 26. As mentioned previously, the strap connector 26 is permanently connected to one of the hand straps 25. It is wrapped around the other hand strap and connected to itself. This results in a configuration that is most beneficial for use of the straps. Also seen in this view is the connection of the cord 52 and 54. The second part of each cord is seen in this view as it extends through a grommet in the side of the sidewall and is extended until it is releasably connected to the first part of the cord.

Figure 3:
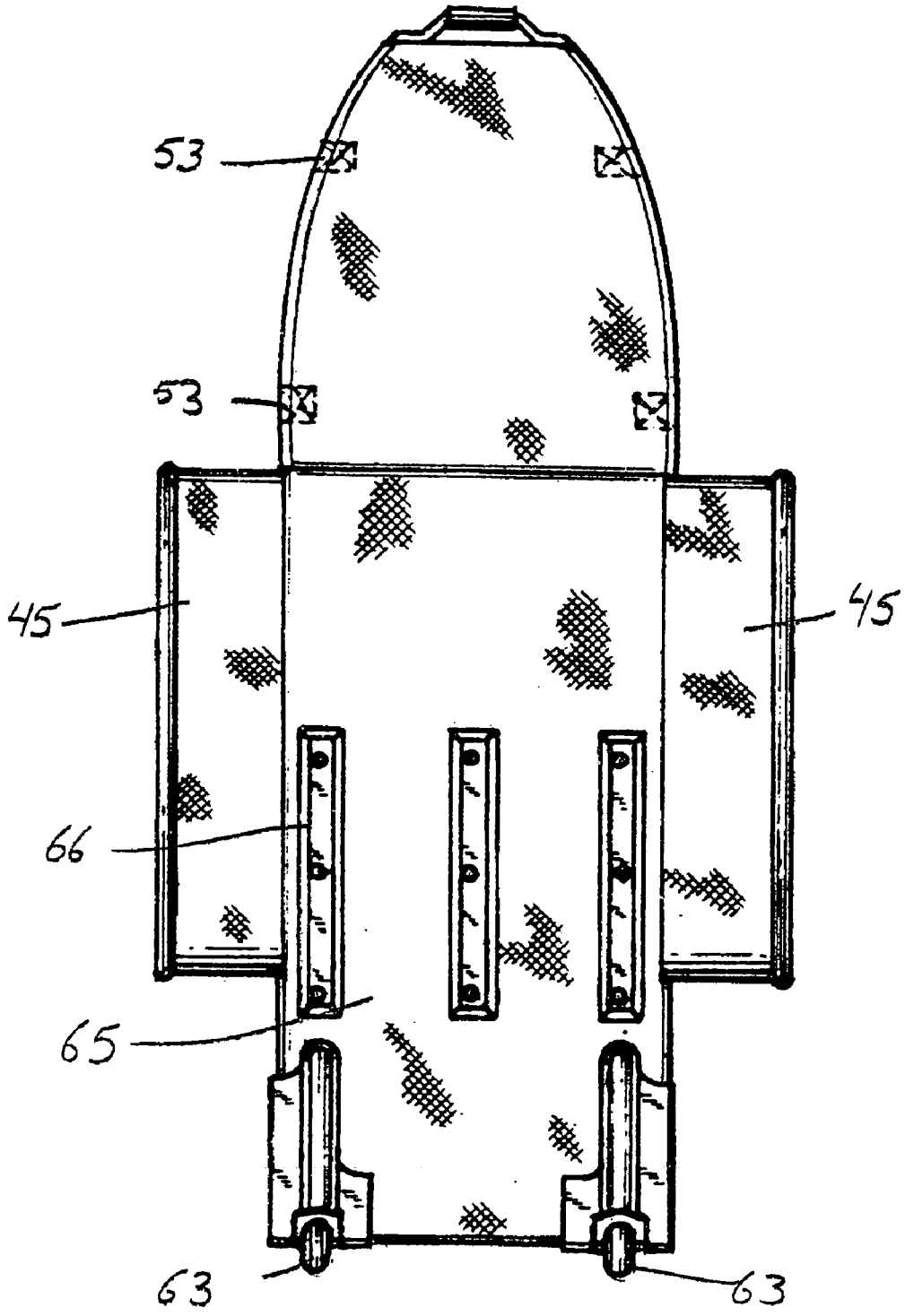
FIG. 3 is a view along line 3—3 of FIG. 2 showing the rear of the bag.

In FIG. 3, the rear view of the carrier is seen. In this view, the anchor point 53 of each cord part is seen. As shown here, the anchor point 53 is formed by stitching the end of each end of the cord parts to the interior of the carrier. The bag has a liner to conceal the cord inside of the carrier. The scuff plate 65 that forms the lower half of the rear of the bag is also clearly seen. The scuff plate 65 has a plurality of rails 66 which extend from the scuff plate 65. These rails protect the carrier by protruding outwardly and will contact any obstacle before the rest of the carrier to protect the carrier from scraping along the obstacle, such as the ground. The pair of wheels 63 used in rolling the carrier are also clearly seen in this figure. In use, the carrier can be tilted backwards so that the wheels are the only part of the carrier touching the ground. The top handle 27 can then be used to pull the bag along the ground surface.

FIG. 4 shows a view of the bottom of the bag. The bottom handle 28 and the D-ring for connection of the shoulder strap are seen at the top of the figure. The extension of the scuff plate 65 along the bottom of the carrier is seen as is the orientation of the wheels 63 relative to the bottom and rear surface of the carrier.

Details of the scuff plate are seen in FIG. 5. clearly seen is the scuff plate 65 extending along the rear and bottom portion of the carrier. Besides protecting the carrier from scrapes, the scuff plate 65 provides an attachment point for the wheels 63. The scuff plate is provided with a flap 67 that covers and is secured to the scuff plate 65 by a pair of mating hook and loop fasteners 68, 69.

Figure 6:
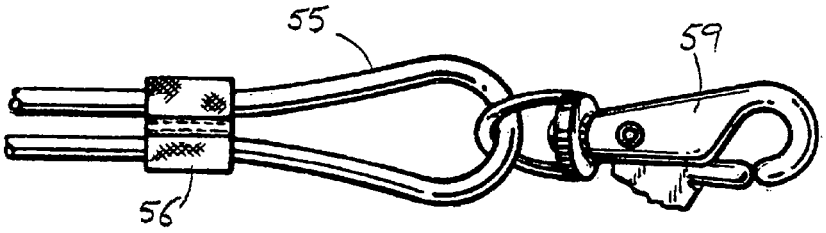
FIG. 6 is a detailed view of one section of the cord.
Figure 7:
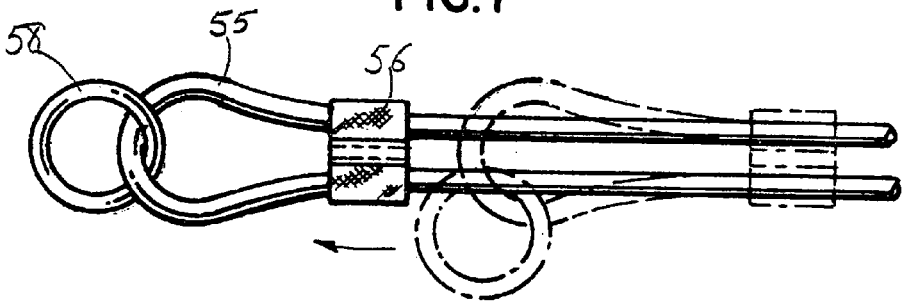
FIG. 7 is a detailed view of the second section of the cord.
Figure 8:
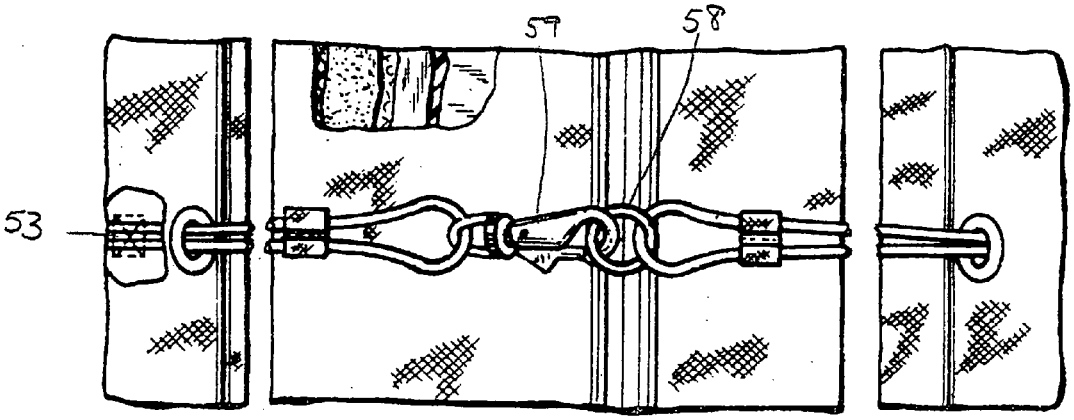
FIG. 8 is a detailed view of the connection of the two cord ends.

Turning now to FIGS. 6 and 7, the details of the cord can be seen. Each cord part is formed by a looped line that is held in the looped configuration by a retainer 65. On one part of the cord, the looped end 55 retains a latch 59. On the other looped end 55 of the other cord part, a ring 58 is retained. The ring 58 and latch 59 serve to releasably attach the two cord parts together. This configuration is shown in FIG. 8.

The cord parts are pulled together until the ends of each cord part are close enough so that the latch 59 can be secured to the ring 58. As seen in the left-hand part of FIG. 8, the cord is attached to the interior of the bag at anchor point 53. By pulling the cords together to attach the two cord parts to one another, the anchor points 53, on opposite sides of the bag, are also brought closer together. The result is to reduce the interior volume of the bag. By reducing the interior volume of the bag, the space with which the clubs can move and hit into one another, causing damage, is reduced. As shown in the cut-away view that forms part of FIG. 8, the top of the bag is provided with a layer of padding. The padding provides support from external impacts and provides the clubs held within the carrier a cushioning surface. The overall result is to reduce any damage that may be caused to the golf clubs during transport.

While the invention has been described with reference to a preferred embodiment, many variations and modifications of the invention can be made without departing from the scope of the invention. The invention is not to be limited to the exact embodiment described but is defined by the appended claims.

What is claimed is:

1. A carrier for a golf bag or the like in which also may be stored items such as a golf bag and golf clubs extending within and without the golf bag, the carrier comprising:

a housing having a closed bottom, a closed top and a sidewall extending between the bottom and top to define an interior volume for receiving and holding therein the golf clubs; and at least first cord means having one end secured to the interior wall of said housing and engaging the exterior of said housing and having one end secured to the interior wall of said housing such that the volume of said housing is thereby reduced so as to restrict the relative movement of the golf clubs stored therein.

2. The carrier as recited in claim 1, wherein said first cord means comprises at least two parts, the free end of one of said parts being engageable with the free end of the other of said parts.

3. The carrier as recited in claim 2, wherein the end opposed to said free end of each said part is secured to the interior of said housing, said parts extending from said interior to without the housing.

4. The carrier as recited in claim 3, wherein said cord means comprises two cords each having said first and second parts, each said cords being disposed substantially parallel to one another.

5. The carrier as recited in claim 4, wherein said housing comprises a substantially cylindrical shape and said cords are spaced from one end of said housing.

6. The carrier as recited in claim 5, wherein said cords are disposed about and proximate the end of said carrier where the golf clubs, when stored therein, extend without the golf bag, said cords being capable of reducing the volume of said housing so as to substantially restrain the golf clubs from moving with respect to one another.

7. The carrier as recited in claim 6, wherein the first and second parts of each of the first and second substantially parallel cords are in a looped configuration.

8. The carrier as recited in claim 7, further comprises a latch and a ring and wherein, for each of said substantially parallel cords, one of said parts retains said latch and the other of said parts retains said ring, said latch and said ring releasably interlocking one to another, whereby said volume of the carrier is reduced and the relative movement of the golf clubs stored therein is greatly reduced.

9. The carrier as recited in claim 1, wherein said cord means comprise first and second set of cord means disposed substantially parallel to one another.

10. The carrier as recited in claim 9, wherein said housing comprises a substantially cylindrical shape and said cord means are spaced from one end of said housing.

11. The carrier as recited in claim 10, further comprising an opening for receiving golf clubs.

12. The carrier as recited in claim 11, wherein said carrier is soft-sided.

13. The carrier as recited in claim 12, wherein said cord means are disposed about and proximate the end of said carrier where the golf clubs when stored therein extend without the golf bag, said cord means being capable of reducing the volume of said housing so as to substantially restrain the golf clubs from moving with respect to one another.

14. The carrier as recited in claim 13, wherein said cord means is in a looped configuration.

15. The carrier as recited in claim 14 further comprising a retainer and wherein said cord means are held in said looped configuration by means of said retainer.

16. The carrier as recited in claim 1, wherein said attached ends of said cord means are attached by means of stitching.

17. The carrier as recited in claim 1, wherein said housing comprises a substantially cylindrical shape and said cord means are spaced from one end of said housing.

18. The carrier as recited in claim 17, further comprising an opening for receiving the golf clubs.

19. The carrier as recited in claim 18, wherein said cord means are disposed about and proximate the end of said carrier where the golf clubs, when stored therein, extend without the golf bag, said cord means being capable of reducing the volume of said housing so as to substantially restrain the golf clubs from moving with respect to one another.

20. The carrier as recited in claim 19, wherein said cord means are in a looped configuration.

21. The carrier as recited in claim 20, wherein the ends of said cord means that are attached to the interior of the housing are attached by means of stitching.

22. The carrier as recited in claim 20, further comprises a retainer and wherein said cord means are held in said looped configuration by means of said retainer.

23. The carrier as recited in claim 1, further comprising an opening for receiving golf clubs.

24. The carrier as recited in claim 23, wherein said opening is in said sidewall.

* * * * *